US006899594B1

(12) United States Patent
Charatan et al.

(10) Patent No.: US 6,899,594 B1
(45) Date of Patent: May 31, 2005

(54) RELATIVE LATERAL MOTION IN LINEAR CMP

(75) Inventors: Robert Charatan, Portland, OR (US); Dae J. Lim, Fremont, CA (US); Peter Norton, Emeryville, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/813,754

(22) Filed: Mar. 30, 2004

(51) Int. Cl.[7] ..... B24B 49/00
(52) U.S. Cl. ..... 451/11; 451/41; 451/59; 451/168; 451/304; 451/307; 451/311
(58) Field of Search ..... 451/59, 63, 168, 451/297, 304, 307, 311, 41, 9, 10, 11

(56) References Cited

U.S. PATENT DOCUMENTS 5,830,046 A * 11/1998 Dugger et al. ..... 451/297
6,001,004 A * 12/1999 Botteghi ..... 451/168
6,336,851 B1 * 1/2002 Shendon ..... 451/303
6,471,568 B1 * 10/2002 Wang ..... 451/168
6,722,966 B1 * 4/2004 Wang ..... 451/304
6,746,320 B2 * 6/2004 Krusell et al. ..... 451/302

* cited by examiner

*Primary Examiner*—Eileen P. Morgan
(74) *Attorney, Agent, or Firm*—Carr & Ferrell LLP

(57) ABSTRACT

Apparatus and methods are disclosed that promote greater polishing uniformity in linear CMP systems by introducing a relative lateral motion between a CMP belt and a rotating polish head securing a wafer. A belt polish module comprises a linear CMP belt forming a loop around an idle roller and a drive roller, first and second pistons engaging, respectively, first and second ends of the idle roller, and a controller configured to vary the forces applied by the first and second pistons to the ends of the idle roller in order to laterally translate the linear CMP belt. A method for linear CMP comprises rotating a wafer about a vertical axis, contacting the rotating wafer against a linear CMP belt moving in a longitudinal direction, and causing a relative lateral motion between the rotating wafer and the linear CMP belt.

26 Claims, 5 Drawing Sheets

RELATIVE LATERAL MOTION IN LINEAR CMP

BACKGROUND OF THE INVENTION

1. Field of the Invention

The present invention relates generally to the field of semiconductor device fabrication and more particularly to apparatus and methods for planarizing surfaces on wafers.

2. Description of the Prior Art

In the field of semiconductor device fabrication, as well as in related manufacturing technologies, the ability to achieve greater miniaturization of devices such as integrated circuits (ICs) relies, in part, on the ability to create ever smoother and flatter surfaces. Planarization is the process of making surfaces more planar, and is commonly performed on wafers at multiple stages of semiconductor fabrication. One technique that is employed to planarize metal, insulator, and semiconducting layers is chemical mechanical polishing (CMP). As the name implies, CMP employs a combination of mechanical polishing and chemical reactions to remove surface materials to produce very flat and smooth surfaces.

Linear CMP is a particular CMP technique that employs a moving CMP belt to polish a wafer. The CMP belt also transports a slurry of reactants to the wafer and removes both reaction products and heat. In order to facilitate the transport of slurry to the wafer, and of reaction products away from the wafer, the CMP belt preferably includes a plurality of grooves. Often, to direct slurry towards the wafer, the grooves are oriented longitudinally, in the direction of travel of the CMP belt. The orientation of the grooves can also include a lateral component. The slurry is typically dispensed onto the CMP belt from a single nozzle or, commonly, from a slurry bar having multiple nozzles (typically 6–15). Ideally, the depth of the slurry as measured across a width of the CMP belt evens out before the slurry reaches the wafer, however, in practice the slurry frequently is unevenly distributed, forming a longitudinal band on the CMP belt for each of the nozzles of the slurry bar.

In linear CMP systems the wafer is typically secured in a polish head. During polishing, the polish head presses the wafer down against the CMP belt while rotating the wafer about a vertical axis. In one type of linear polishing system, air delivered through holes in a platen situated on the opposite side of the CMP belt from the wafer supports the moving CMP belt against the pressure from the polish head. It will be appreciated that although rotating the wafer tends to even out the effects of unevenly distributed slurry and of the grooves in the CMP belt, this smoothing effect is imperfect. Additionally, the benefits of wafer rotation lessen considerably at both the center and at the circumference of the wafer.

For example, as the polish head presses the wafer against the CMP belt, the polish head defines a wafer track on the CMP belt and forces slurry laterally out from the wafer track. This slurry tends to accumulate in two parallel bands on the CMP belt near the two edges of the wafer track. Accordingly, although the points on the wafer near the circumference traverse the greatest width of the CMP belt with each revolution, points near the circumference of the wafer also pass through these bands of excess slurry twice per revolution and tend to become over-polished. Similarly, the longitudinal bands of slurry that correspond to the nozzles of the spray bar can also create rings of over-polishing on the wafer, though this effect is typically less extreme than at the circumference.

A similar effect can occur at the center of the wafer. Specifically, it will be appreciated that although the wafer is rotating, a point at the center of the wafer is polished only by a single longitudinal line at the center of the wafer track, and, similarly, points on the wafer very near to the center are polished only by a narrow band of the CMP belt that is centered on that center line of the wafer track. If this narrow band includes one of the longitudinal grooves, or happens to correspond to a region with an excess or a deficient amount of slurry, then the center of the wafer will be polished differently than the remainder of the wafer and can become either over-polished or under-polished. FIG. 1 shows profiles across several wafers to illustrate the problems with polishing uniformity as a function of wafer radius.

Another problem with linear CMP systems is that the CMP belts wear unevenly. With the use of certain slurry types and belt groove patterns, the wafer track on the CMP belt can become smoothed, commonly referred to as glazing, which causes loss of removal performance. Since every point on the wafer crosses the center line twice per revolution, the center of the wafer track performs the most polishing, and therefore the center of the wafer track can glaze faster than the remainder of the wafer track. This uneven glazing of the CMP belt within the wafer track causes under-polishing towards the center of the wafer.

Therefore, what is needed is an apparatus and method to promote greater polishing uniformity in linear CMP systems.

SUMMARY

The invention provides a linear belt CMP system comprising a rotatable wafer chuck and a belt polishing module. The rotatable wafer chuck is configured to secure a wafer for rotation about a vertical axis. The belt polishing module includes a first roller, a linear CMP belt forming a continuous loop around the first roller, and a control mechanism configured to vary the variable force applied by a first piston to a first end of the first roller in order to laterally translate the linear CMP belt. The first roller can be any roller such as an idle roller or a drive roller for translating the linear CMP belt in a longitudinal direction. The belt polishing module, in some embodiments, includes a second piston engaging a second end of the first roller and that is effective to apply a variable force to the second end of the first roller.

The control mechanism of the belt polishing module can include a belt position sensor for determining a position of the linear CMP belt, and in some embodiments the control mechanism is further configured to control the first piston according to a signal from the belt position sensor. In those embodiments that include first and second pistons engaging, respectively, first and second ends of the first roller, the control mechanism can be further configured to coordinate the variable forces applied by the first and second pistons. Also, in some of these embodiments, the control mechanism includes a first controller configured to vary the variable force applied by the first piston and a second controller configured to vary the variable force applied by the second piston. The control mechanism can be further configured to vary the variable forces applied to the first and second pistons by modulating the variable forces, to maintain a phase difference between the variable forces applied by the first and second pistons, and/or to vary the variable forces applied by the first and second pistons according to a waveform, for example, a triangle wave.

The invention also provides a method for linear CMP of a wafer. The method comprises rotating the wafer about a vertical axis, contacting the rotating wafer against a linear CMP belt moving in a longitudinal direction relative to the vertical axis, and causing a relative lateral motion between the rotating wafer and the linear CMP belt. In some embodiments causing the relative lateral motion includes oscillating the linear CMP belt in a lateral direction. In some of these embodiments oscillating the linear CMP belt includes oscillating the linear CMP belt by a small multiple of a groove pitch of the linear CMP belt. Also, in some of these embodiments oscillating the linear CMP belt includes oscillating the linear CMP belt by an integer number of oscillations within a polish time of the wafer, and/or translating the linear CMP belt at an approximately constant rate between ends of travel.

DETAILED DESCRIPTION OF THE INVENTION

The invention provides apparatus and methods to promote greater polishing uniformity in linear CMP systems. By introducing a relative lateral motion between a CMP belt and a rotating wafer secured by a polish head, the effects of unevenly distributed slurry, glazing, and longitudinal grooves in the CMP belt can be ameliorated across the entire wafer. The relative lateral motion insures that the center of the wafer is polished by a band on the CMP belt, rather than just a single longitudinal line. The relative lateral motion also ensures that any slurry forced out from between the CMP belt and the wafer is distributed over a greater width on the CMP belt, reducing the tendency for the circumference of the wafer to be over-polished. Further, the relative lateral motion distributes the polishing across a greater width of the CMP belt, widening the wafer track. Widening the wafer track reduces the rate at which the wafer track glazes and also reduces the disparity in the amount of glazing from the center to the edges of the wafer track. Thus, the life of the CMP belt is also increased.

Figure 1:
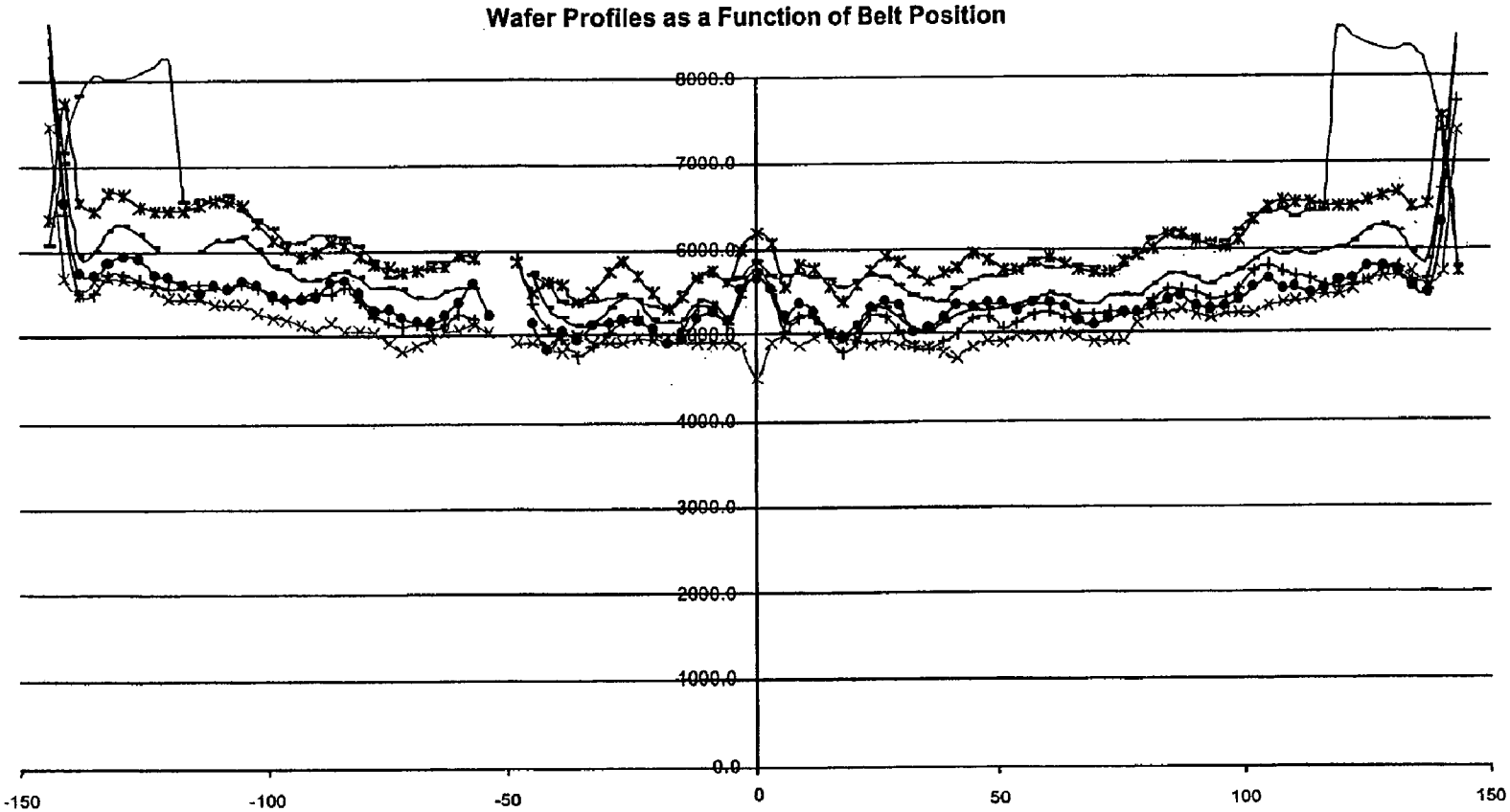
FIG. 1 (Prior Art)
FIG. 1 shows profiles of several wafers polished according to the prior art.
Figure 2:
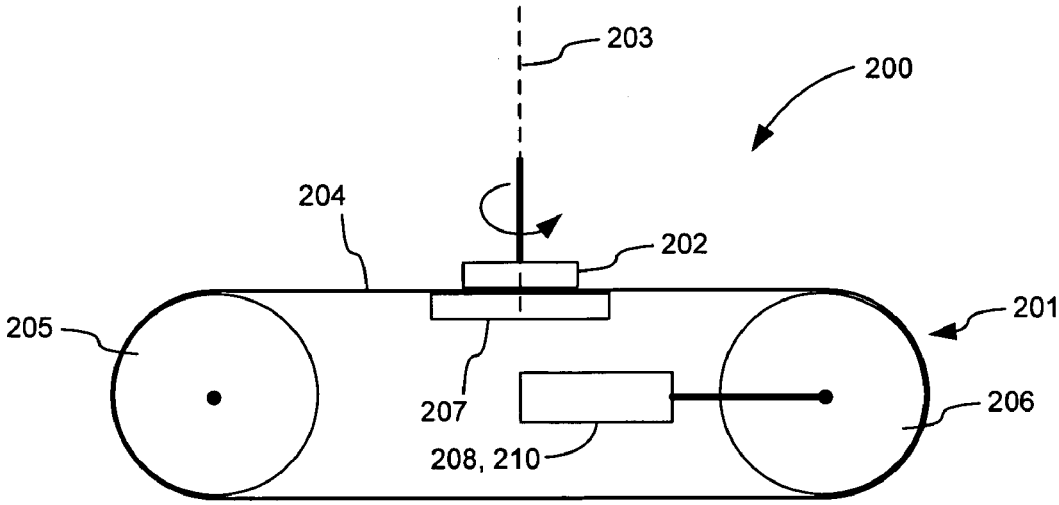
FIGS. 2 and 3 are side and top views, respectively, of an exemplary linear belt system according to an embodiment of the invention.
Figure 3:
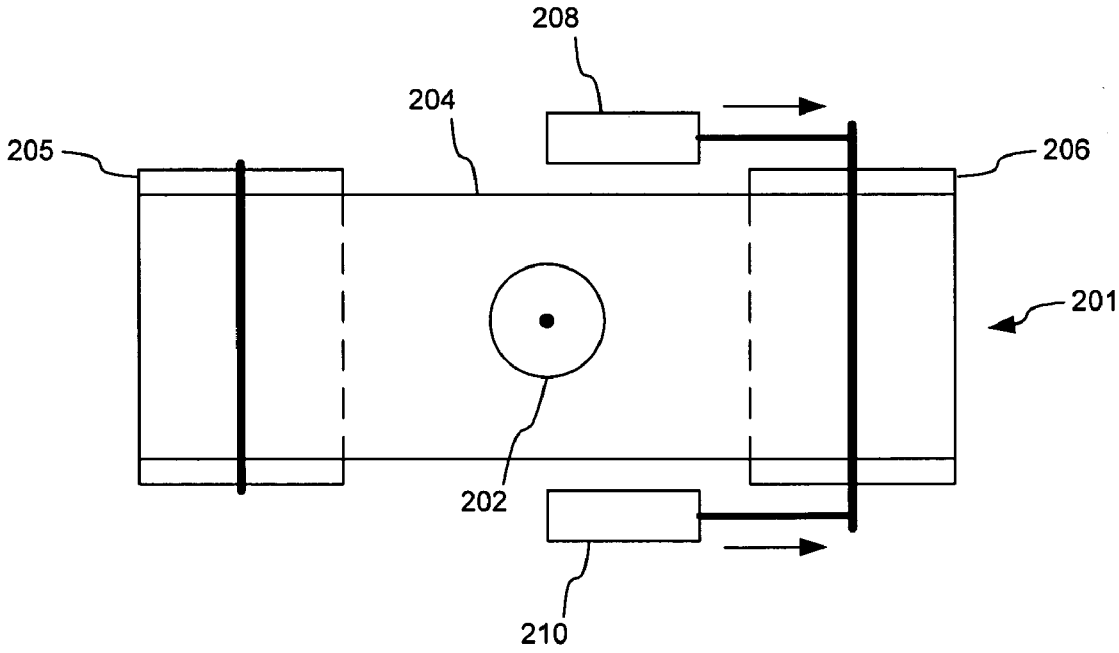

FIGS. 2 and 3 show side and top views, respectively, of an exemplary linear belt system 200 of the invention comprising a belt polish module 201 and a polish head 202. The polish head 202 is configured to secure a wafer, or similar substrate, while rotating about a vertical axis 203 at up to about 100 rpm, as shown in FIG. 2. The polish head 202 applies a pressure, typically about 0.3 to 8 psi, to the wafer to press the wafer against the belt polishing module 201. Mechanisms for applying the pressure and rotating the polish head 202 are not shown, but are well known in the art.

The belt polish module 201 includes a CMP belt 204 looped around two rollers, a drive roller 205 and an idle roller 206. A platen 207 situated on the opposite side of the CMP belt 204 from the polish head 202 supports the moving CMP belt 204 against the pressure from the polish head 202. The CMP belt 204, in some embodiments, comprises a polyurethane layer that can include longitudinal grooves for improved transport of both slurry and reaction by-products. In some embodiments the CMP belt 204 also comprises a backing layer beneath the polyurethane polishing layer that is made of strands of stainless steel or Kevlar-polyester. In other embodiments, to better protect system components which can contact the CMP belt 204, an additional backing layer such as polyurethane, polyester, polyethylene, or Teflon can be added on a side of the stainless steel or Kevlar-polyester opposite the polyurethane polishing layer. The longitudinal grooves can be oriented essentially in the longitudinal direction or can be defined at an angle to the longitudinal direction. In some embodiments, the groove pitch, which is the spacing between adjacent grooves on the CMP belt 204, is about 0.1".

The belt polish module 201 also includes first and second pistons 208, 210 that engage opposite ends of the idle roller 206. Each piston 208, 210 is effective to apply a variable force to the respective end of the idle roller 206. In operation, the drive roller 205 drives the CMP belt 204 at up to about 600 feet per minute, and the idle roller 206 both provides tension to the CMP belt 204 and causes the CMP belt 204 to move laterally. The pistons 208, 210 maintain the proper tension on the CMP belt 204 by maintaining a force on the idle roller 206 in a direction away from the drive roller 205, as shown in FIG. 3. It will be appreciated that, as used herein, a piston is any suitable actuator or mechanical device that is effective to apply a variable force.

Figure 4:
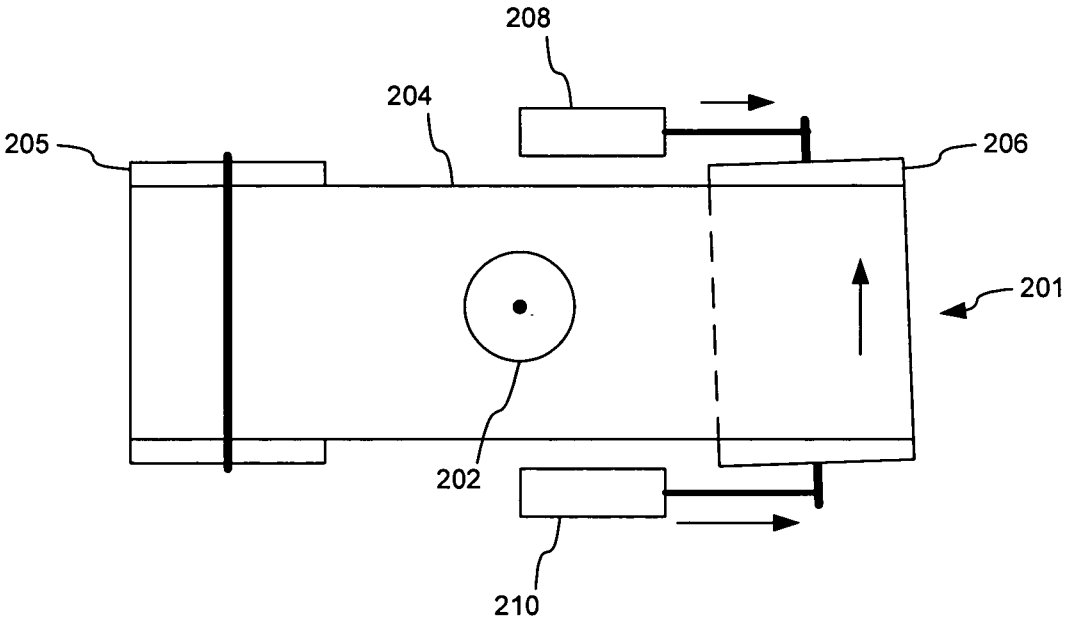
FIG. 4 is a top view of the linear belt system of FIGS. 2 and 3 producing relative lateral motion according to an embodiment of the invention.

The pistons 208, 210 also cause the CMP belt 204 to move laterally, as shown in FIG. 4. Applying less force through piston 208 than piston 210 causes the CMP belt 204 to move laterally in the direction of the lower force. Accordingly, the CMP belt 204 can be made to repeatedly travel back and forth on the rollers 205, 206 by modulating the forces applied by the pistons 208, 210. Here, modulating refers to varying in an oscillatory manner but without necessarily a fixed waveform, periodicity, or amplitude. Moving the CMP belt 204 by just a few multiples of the groove pitch can provide sufficient lateral motion to ameliorate the effects of unevenly distributed slurry, glazing, and longitudinal grooves in the CMP belt. Further, in some embodiments it is sufficient for the CMP belt 204 to cycle between the ends of its travel as little as a few times per minute.

The method is particularly effective when an amplitude of the lateral motion is a small multiple of the groove pitch and when an integer number of oscillations occur within the polish time of the wafer. However, even non-integer numbers of oscillations will provide a beneficial averaging over time to smooth out variations in the rate of material removal from the surface of the wafer as a function of radius. It should be noted that the CMP belt 204 has a natural oscillation period, on the order of about 10 to 20 seconds, and therefore has a response time to changes in the forces exerted by the pistons 208, 210. The CMP belt 204 will respond poorly, if at all, to changes from the pistons 208, 210 that vary more rapidly than the natural oscillation period.

The linear belt system 200 also includes a control mechanism that controls the pistons 208, 210 to steer the CMP belt 204 while maintaining the correct tension. An exemplary control mechanism 500 is illustrated schematically in FIG. 5. In some embodiments the control mechanism 500 includes a controller 502 in electrical communication with the pistons 208, 210. In some embodiments, before the polish head 202 is brought into contact with the CMP belt 204, the controller 502 sets the CMP belt 204 to a desired tension by adjusting the forces exerted by the pistons 208, 210 on their respective ends of the idle roller 206. Then, once the polish head 201 is engaged with the CMP belt 204, the controller 502 modulates the forces exerted by the pistons 208, 210.

It will be appreciated that if the forces exerted by the pistons 208, 210 are modulated without a phase difference, in other words, such that the pistons 208, 210 are synchronized to exert maximum and minimum levels of force in unison, then the CMP belt 204 will not move laterally; instead only the tension on the CMP belt 204 will vary with time. Accordingly, although the controller 502 applies a common waveform to each piston 208, 210, the controller 502 should coordinate the forces exerted by the pistons 208, 210 in order to maintain a phase difference between them. In some embodiments the controller 502 maintains a phase difference of 180° between the waveforms applied to the two pistons 208, 210.

Figure 6:
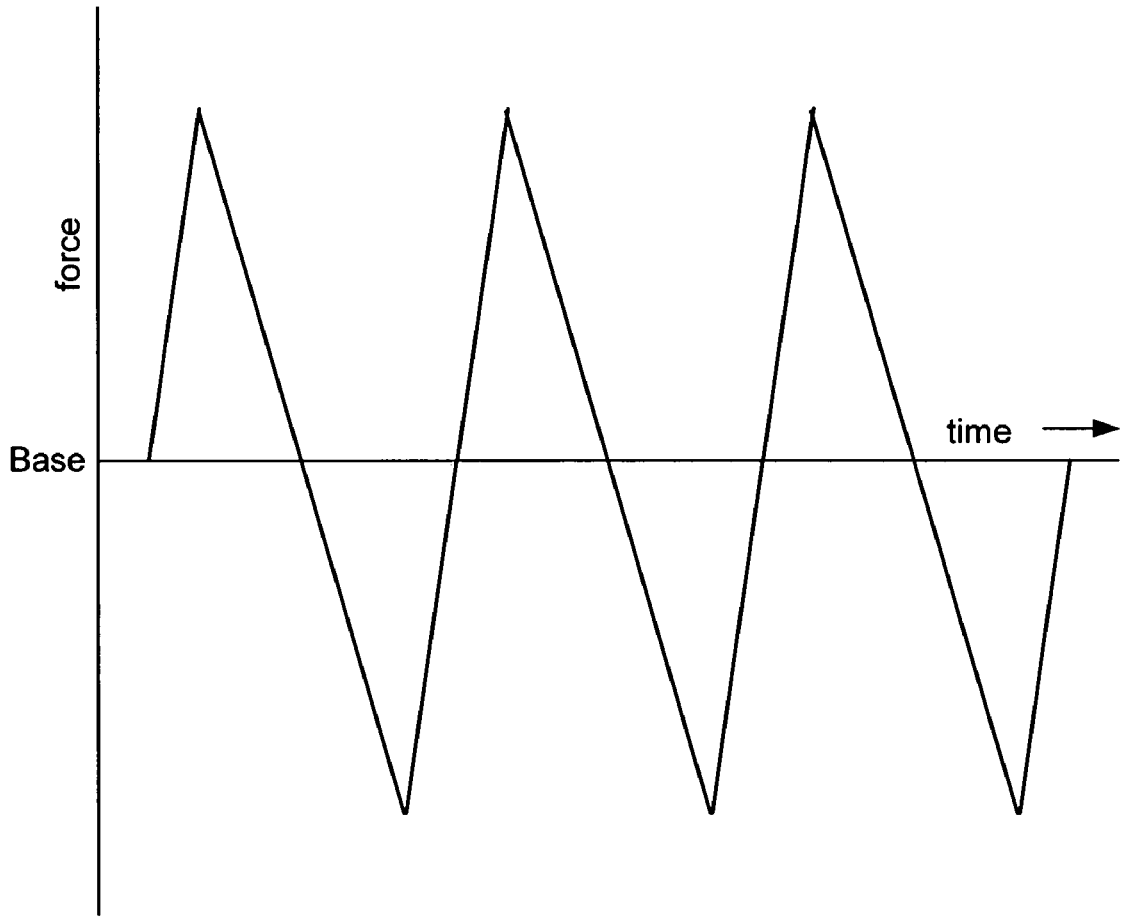
FIG. 6 is an exemplary triangle waveform according to an embodiment of the invention.

The waveform applied to the pistons 208, 210 can be essentially any cyclical pattern such as sinusoidal wave or a square wave. A representative triangle wave is shown in FIG. 6. A triangle wave can be particularly effective for achieving a simple average over multiple grooves in the CMP belt 204 because a triangle wave causes the rate of the lateral motion to be approximately constant between the ends of the travel. In the example shown in FIG. 6, the triangle wave varies around a base force needed to maintain the desired tension on the CMP belt 204. It should be noted that, as in FIG. 6, the ascending and descending sides of the waveform do not need to be symmetrical. It should also be noted that the output from controller 502 is not limited to waveforms, and in some embodiments, to better randomize conditions, the controller 502 is configured to coordinate the forces exerted by the pistons 208, 210 such that the linear CMP belt 204 is moved in a non-periodic or even random manner.

In some embodiments the control mechanism 500 includes a belt position sensor 504 in electrical communication with the controller 502. The belt position sensor 504 is used to determine the location of the CMP belt 204 as it travels laterally. The belt position sensor 504 determines the location of the CMP belt 504, in some embodiments, by monitoring an edge thereof. Also in some embodiments the belt position sensor 504 employs sonar to track the edge of the CMP belt 204 by sending out ultrasonic sound waves and monitoring the reflections off of the edge.

In some instances the location information is merely used to prevent the CMP belt 204 from traveling too far in either direction. In these instances the controller 502 can modify an attribute of the waveform being applied to the pistons 208, 210 to prevent excess travel. For example, the controller can reduce an amplitude of the waveform or alter the phase difference between the waveforms applied to the pistons 208, 210.

In other instances the location information is part of an active feedback loop. Thus, for example, rather than sending a fixed waveform to each piston 208, 210, the controller 502 can be configured to laterally move the CMP belt 204 over a specific distance and at a controlled rate. In these instances the controller 502 uses the location information from the belt position sensor 504 to tune the forces applied to the pistons 208, 210 so that the lateral motion of the CMP belt 204 is kept close to the desired settings.

Although the belt polish module 201 of FIGS. 2 and 3 is configured to steer the CMP belt 204 by adjusting the idle roller 206, other embodiments of the belt polish module 201 can adjust other rollers to steer the CMP belt 204. For example, the pistons 208, 210 can instead engage opposite ends of the drive roller 205 to cause the CMP belt 204 to move laterally. The belt polish module 201 can also be configured with a third roller (not shown) such that the CMP belt 204 is looped around all three rollers. In such embodiments the pistons 208, 210 can instead engage opposite ends of the third roller to cause the CMP belt 204 to move laterally. It will be appreciated that in some embodiments more than one of the rollers can be equipped with pistons analogous to pistons 208, 210. For example, in a three-roller system one roller is a drive roller, one roller is an idle roller that is equipped with pistons 208, 210 to maintain tension on the CMP belt 204, and a third roller is an idle roller that is equipped with pistons 208, 210 to steer the CMP belt 204. In some embodiments in which more than one roller is equipped with pistons 208, 210, the so equipped rollers are controlled to act cooperatively such that the rollers together maintain the tension and steer the CMP belt 204.

Similarly, although the belt polish module 201 of FIGS. 2 and 3 is configured to steer the CMP belt 204 with two pistons 208, 210 that engage opposite ends of the idle roller 206, it will be appreciated that in other embodiments the CMP belt 204 is steered by a single piston, either piston 208 or 210. In some of these embodiments both pistons 208, 210 are used to maintain a tension on the CMP belt 204 while only one piston 208, 210 applies a variable force to steer the CMP belt 204, while in other embodiments one piston, either piston 208 or 210, is eliminated. In these embodiments one end of the idle roller 206 is engaged by the remaining piston 208 or 210 while the other end is not dynamically moveable. In some of these embodiments a tension on the CMP belt 204 is maintained, for example, by a third roller (not shown), as described elsewhere herein.

Figure 5:
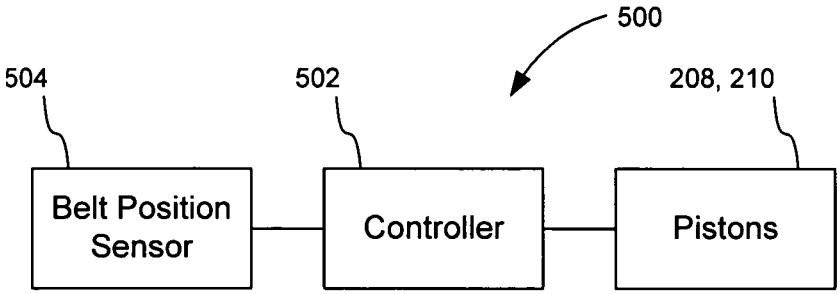
FIG. 5 is a schematic diagram of an exemplary control mechanism according to an embodiment of the invention.

Further, although FIG. 5 describes a control mechanism 500 that includes a single controller 502 that operates both pistons 208, 210, it will also be appreciated that the control mechanism 500 can include a separate controller for each of the pistons 208, 210. In these embodiments the separate controllers for the two pistons 208, 210 act cooperatively to maintain a phase difference, as described elsewhere herein. In those embodiments that include a third roller and further pistons, as described elsewhere herein, the control mechanism 500 can be configured to coordinate all of the pistons through a single controller 502 or through a combination of controllers.

Figure 7:
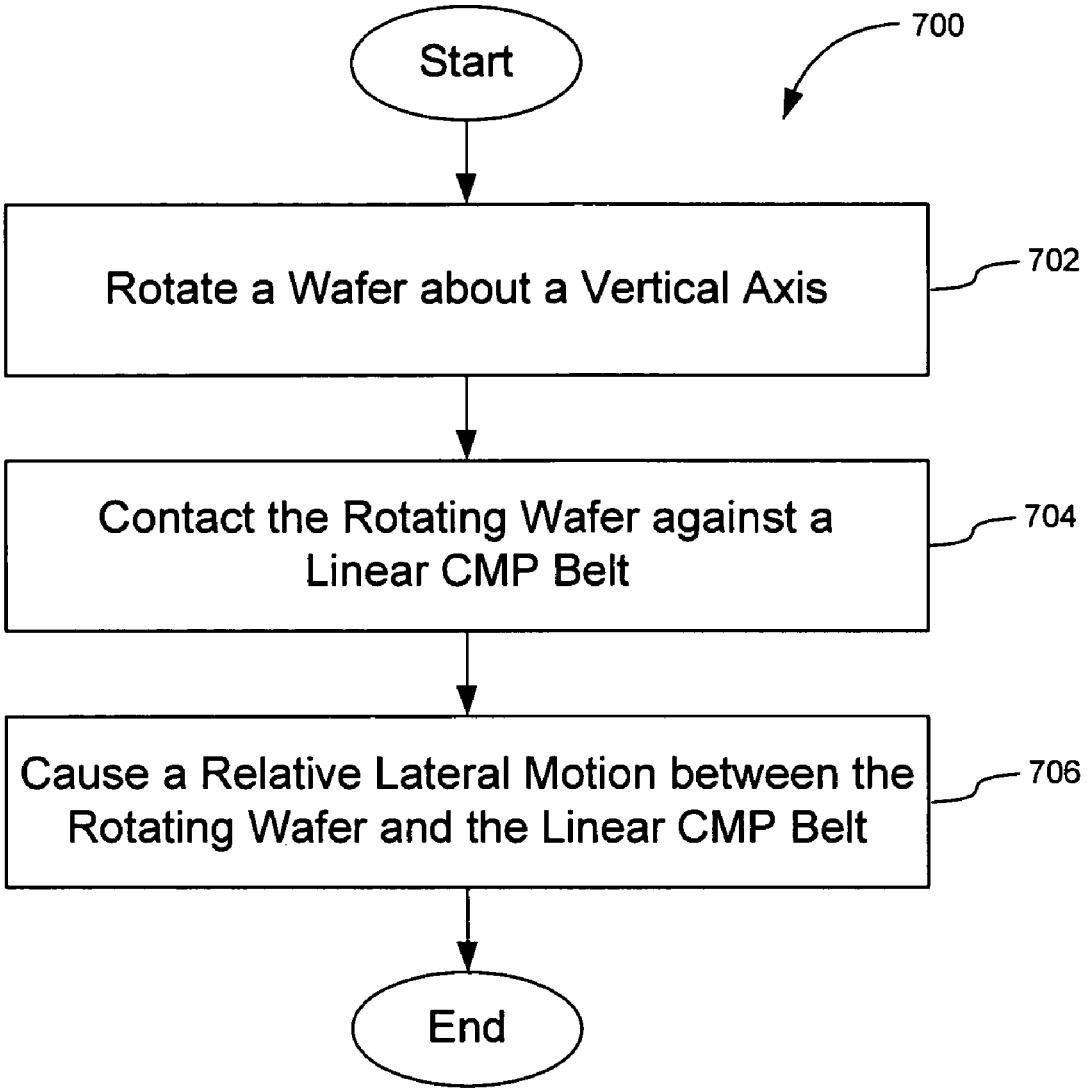
FIG. 7 is a flow chart showing an exemplary embodiment of the method of the invention.

The invention also provides a method 700 for linear CMP of a wafer, as shown in FIG. 7. The method includes a step 702 of rotating the wafer about a vertical axis, a step 704 of contacting the rotating wafer against a CMP belt moving in a longitudinal direction relative to the vertical axis, and a step 706 of causing a relative lateral motion between the rotating wafer and the CMP belt. Although FIG. 7 shows step 706 as following step 704, it will be understood that the relative lateral motion can be initiated before the wafer is contacted against the CMP belt.

It will be appreciated that although the invention has been described with particular reference to a linear belt system 200 (FIGS. 2 and 3) that steers the CMP belt 204 to provide the relative lateral motion, causing the oscillatory relative lateral motion in step 706 can be achieved by other means as well. For example, a polish head 202 for securing the wafer can be laterally oscillated relative to the CMP belt 204. In some of these embodiments the polish head 202 can be affixed to an arm or other mechanism that sweeps the polish head 202 back and forth along a straight line or along an arc. In other embodiments the polish head 202 can be moved in a circular or orbital motion relative to the CMP belt 204. Likewise, the relative lateral motion in step 706 can be caused by translating the entire belt polish module 201 beneath the polish head 202 instead of moving the CMP belt 204 laterally on the rollers as shown in FIG. 4. Here, too, a variety of different lateral motions, such as linear and circular, can be used to translate the belt polish module 201 beneath the CMP belt 204. Further, it will be appreciated that the relative lateral motion in step 706 can also be produced by using combinations of these techniques, such as by oscillating the polish head 202 while laterally moving the CMP belt 204.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A belt polish module comprising:

a first roller;

a linear CMP belt forming a continuous loop around the first roller;

a first piston engaging a first end of the first roller and effective to apply a variable force to the first end of the first roller; and a control mechanism configured to vary the variable force applied by the first piston to the first end of the first roller in order to laterally translate the linear CMP belt.

2. The belt polish module of claim 1 wherein the first roller is an idle roller.

3. The belt polish module of claim 1 wherein the first roller is a drive roller for translating the linear CMP belt in a longitudinal direction.

4. The belt polish module of claim 1 further comprising a second piston engaging a second end of the first roller and effective to apply a variable force to the second end of the first roller.

5. The belt polish module of claim 4 wherein the control mechanism is further configured to coordinate the variable forces applied by the first and second pistons to the respective ends of the first roller in order to laterally translate the linear CMP belt.

6. The belt polish module of claim 4 wherein the control mechanism includes a first controller configured to vary the variable force applied by the first piston and a second controller configured to vary the variable force applied by the second piston.

7. A belt polish module comprising:

a linear CMP belt forming a continuous loop around an idle roller and a drive roller for translating the linear CMP belt in a longitudinal direction;

first and second pistons engaging, respectively, first and second ends of the idle roller, each piston being effective to apply a variable force to the respective end of the idle roller; and a control mechanism configured to vary the variable forces applied by the first and second pistons to their respective ends of the idle roller in order to laterally translate the linear CMP belt.

8. The belt polish module of claim 7 wherein the control mechanism includes a belt position sensor for determining a position of the linear CMP belt.

9. The belt polish module of claim 8 wherein the control mechanism is further configured to control the first and second pistons according to a signal from the belt position sensor.

10. The belt polish module of claim 7 wherein the control mechanism is further configured to vary the variable forces applied to the first and second pistons by modulating the variable forces.

11. The belt polish module of claim 7 wherein the control mechanism is further configured to maintain a phase difference between the variable forces applied by the first and second pistons.

12. The belt polish module of claim 7 wherein the control mechanism is further configured to vary the variable forces applied by the first and second pistons according to a waveform.

13. The belt polish module of claim 12 wherein the waveform is a triangle wave.

14. A linear belt CMP system comprising:

a rotatable wafer chuck configured to secure a wafer for rotation about a vertical axis; and a belt polish module comprising a linear CMP belt forming a continuous loop around a drive roller and an idle roller for translating the linear CMP belt in a longitudinal direction, first and second pistons engaging, respectively, first and second ends of the idle roller, each piston effective to apply a variable force to the respective end of the idle roller, and a control mechanism configured to vary the force applied by the first and second pistons to their respective ends of the idle roller in order to laterally translate the linear CMP belt in an oscillatory manner.

15. The linear belt CMP system of claim 14 wherein the control mechanism includes a belt position sensor for determining a position of the linear CMP belt.

16. The linear belt CMP system of claim 15 wherein the control mechanism is further configured to control the first and second pistons according to a signal from the belt position sensor.

17. The linear belt CMP system of claim 14 wherein the control mechanism is further configured to vary the variable forces applied to the first and second pistons by modulating the variable forces.

18. The linear belt CMP system of claim 14 wherein the control mechanism is further configured to maintain a phase difference between the variable forces applied by the first and second pistons.

19. The linear belt CMP system of claim 14 wherein the control mechanism is further configured to vary the variable forces applied by the first and second pistons according to a waveform.

20. The linear belt CMP system of claim 14 wherein the control mechanism is further configured to coordinate the variable forces applied by the first and second pistons to the respective ends of the idle roller.

21. A linear belt CMP system comprising:

a rotatable wafer chuck configured to secure a wafer for rotation about a vertical axis; and a belt polish module comprising a linear CMP belt forming a continuous loop around a roller and configured to be translated in a longitudinal direction, and means for laterally translating the linear CMP belt relative to the roller to cause an oscillatory relative lateral motion between the CMP belt and the rotatable wafer chuck.

22. A method for linear CMP of a wafer comprising:

rotating the wafer about a vertical axis;

contacting the rotating wafer against a linear CMP belt moving in a longitudinal direction relative to the vertical axis, the linear CMP belt forming a continuous loop around a roller; and laterally translating the linear CMP belt relative to the roller to cause a relative lateral motion between the rotating wafer and the linear CMP belt.

23. The method of claim 22 wherein laterally translating the linear CMP belt relative to the roller includes oscillating the linear CMP belt in a lateral direction.

24. The method of claim 23 wherein oscillating the linear CMP belt includes oscillating the linear CMP belt by an amplitude approximately equal to a multiple of a groove pitch of the linear CMP belt.

25. The method of claim 23 wherein oscillating the linear CMP belt includes oscillating the linear CMP belt by an integer number of oscillations within a polish time of the wafer.

26. The method of claim 23 wherein oscillating the linear CMP belt includes translating the linear CMP belt at an approximately constant rate between ends of travel.

* * * * *